United States Patent [19]

Tsukuda et al.

[11] Patent Number: 4,715,178

[45] Date of Patent: Dec. 29, 1987

[54] EXHAUST PORT ASSEMBLY

[75] Inventors: Yasuo Tsukuda, Tokyo; Hisao Hara, Kumagaya; Hideki Harada; Yasuo Iizuka, both of Saitama, all of Japan

[73] Assignee: Hitachi Metals, Ltd., Japan

[21] Appl. No.: 636,509

[22] Filed: Aug. 1, 1984

[30] Foreign Application Priority Data

Aug. 3, 1983 [JP] Japan ..... 58-142133

[51] Int. Cl.[4] ..... F01N 3/10

[52] U.S. Cl. ..... 60/272; 60/282; 123/193 H; 164/98

[58] Field of Search ..... 60/272, 282; 123/193 H; 164/98

[56] References Cited

U.S. PATENT DOCUMENTS 4,031,699 6/1977 Suga ..... 60/282

4,206,598 6/1980 Rao ..... 60/282

*Primary Examiner*—Douglas Hart

*Attorney, Agent, or Firm*—Finnegan, Henderson, Farabow, Garrett & Dunner

[57] ABSTRACT

An improved exhaust port assembly, for an internal combustion engine comprises a port pipe made of heat resistance steel covered by a fibrous ceramic sheet which is covered by an aluminum foil to prevent molten aluminum from penetrating the fibrous ceramic sheet when aluminum casting.

5 Claims, 1 Drawing Figure

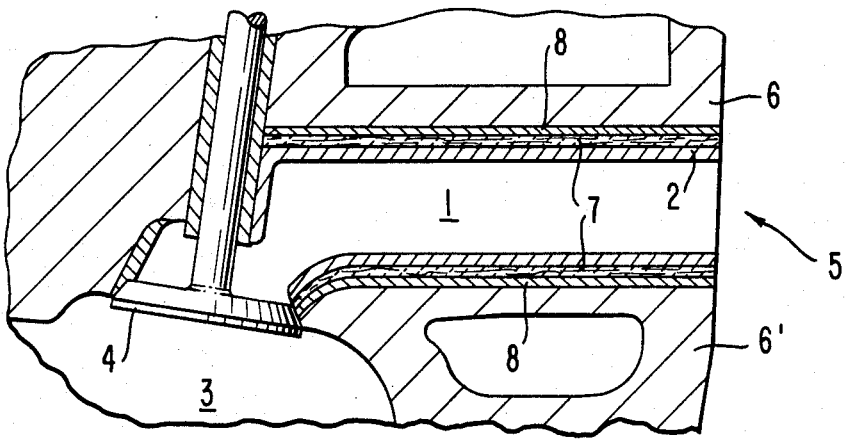
8
6
1
7
2
5
4
8
6'
3

EXHAUST PORT ASSEMBLY

BACKGROUND OF THE INVENTION (1) Field of the Invention

This invention relates to an internal combustion engine, particularly to an improved exhaust port assembly in the engine.

(2) Description of the Prior Art

In an internal combustion engine, maintaining the temperature of the exhaust gas is useful to reduce carbon monoxide and hydrocarbons in the exhaust gas and to improve turbo-charger efficiency. For that purpose, a port pipe has been used which is covered by a fibrous ceramic impregnated with an organic salt and which is cast by cast aluminum to form a cylinder head block of an engine. But, the port has some disadvantages, for example, (1) softness of the fibrous ceramic layer was lost and the layer tends to be broken by mechanical shaking or thermal shock, (2) the manufacturing process requires a step of drying and sintering the impregnated salt and this results in an expensive added cost, and (3) the fibrous ceramic layer includes a lot of pores even after being impregnated. At casting, molten aluminum goes into the pores so that heat insulation capability tends to be lost.

SUMMARY OF THE INVENTION

An object of this inventione is to remove the problems in the prior art and to provide an exhaust port which has been improved in manufacturing cost, heat insulation capacity and thermal and mechanical shock resistivity.

According to this invention, an exhaust port comprises a port pipe of heat resistance steel the outside surface of which is coated with a fibrous ceramic sheet which is, in turn, covered by a thin metal layer, the port pipe covered by the fibrous ceramic sheet and the thin metal layer being cast to form a cylinder head block of an engine and connecting a combustion chamber in the engine to an exhaust system. The cylinder head block is usually made of cast aluminum. It is preferable that the thin metal layer is aluminum foil.

The port of this invention has on its outside surface a fibrous ceramic sheet covered by a thin metal layer to prevent cast aluminum from contacting the fibrous ceramic sheet in order that the fibrous ceramic sheet can be maintained in a condition of non-solidification by aluminum.

BRIEF DESCRIPTION OF THE DRAWING

The FIGURE shows a cross-sectional view of an internal combustion engine around an exhaust port according to this invention.

DESCRIPTION OF THE PREFERRED EMBODIMENTS

Referring to the FIGURE, an exhaust port 1 according to this invention comprises a port pipe 2 made of heat resistance steel, e.g., stainless steel AISI 310S. The port pipe 2 connects a combustion chamber 3 through a valve 4 at one end and an exhaust system 5 at the other end, the exhaust system 5 comprising an exhaust manifold, a turbo-charger, gas treatment equipment using a catalytic oxidation process, an exhaust pipe, etc., which are not shown in the FIGURE. The port pipe 2 is cast in an aluminum cylinder block 6. Between the outer surface of the port pipe 2 and the cast aluminum 6, there are deposited a fibrous ceramic sheet 7 and a thin metal layer, e.g., aluminum foil 50 μm thick. These two layers of the ceramic sheet 7 and the thin metal 8 layer are sandwiched.

The engine which was used in experiment comprised a cylinder block made of cast aluminum alloy (SAE 331) and a port pipe made of stainless steel (310S) which has a 35 mm inside diameter, is 150 mm long and 1.2 mm thick. As a fibrous ceramic sheet, $Al_2O_3$—$SiO_2$ fibrous ceramic sheet was used. The $Al_2O_3$—$SiO_2$ ceramic sheet had a composition of 47.3 wt.% $Al_2O_3$, 52.3 wt.% $SiO_2$, 0.10 wt.% $TiO_2$ and 0.10 wt.% alkali oxide after ignition and a density of 0.31 g/cm$^3$. Such a sheet is available as Kaowool Paper (trademark) from Isolite Industries Co., Kita-ku, Osaka, Japan. The stainless steel pipe was covered by the sheet and over-covered by an aluminum foil 50 μm thick. The covered pipe was cast by cast aluminum alloy (SAE331) to form the cylinder block.

A reference engine was made by the same manner as described above but did not have the aluminum foil cover on the ceramic sheet.

These engines were tested in a cycle comprising 30 minute operation and 10 minute stop. After repeating 1500 cycles of the test, the results shown in the below table were obtained.

TABLE

| Engine | Temperature on inside wall of port (°C.) Inlet | Outlet | Crack appearance in ceramic layer after 1500 cycles |
|---|---|---|---|
| Reference | 620 | 540 | Many cracks |
| Invention | 620 | 580 | No crack |

At the inlet of the port pipe, the temperature on the inside wall of the port was measured 620° C., for the inside wall at the inlet was exposed to high temperature combustion gas coming from the combustion chamber.

In the reference engine, the exhaust gas was cooled by heat exchange through the wall of the port, aluminum-solidified fibrous ceramic layer and cast aluminum with coolant during a period of passing through the port, so the temperature on the inside wall at the outlet reduced to 540° C. On observing the ceramic layer after 1500 cycles test, there were found many cracks in the ceramic layer resulting from thermal shock.

In the engine of this invention, little temperature reduction was found and the temperature was maintained at a level much higher than that in the reference. The ceramic layer was essentially uncontaminated by the cast aluminum because the aluminum foil covering the ceramic layer prevented the cast aluminum from penetrating into the ceramic layer. It was observed that the aluminum foil was partially melted when aluminum was cast around the port pipe but, when the cast aluminum melted the foil, the melting aluminum was solidified at the foil front and was not able to penetrate the ceramic layer. After 1500 cycles test no cracks were found in the ceramic layer.

As discussed above, the exhaust port of the present invention having the coating by a metal thin layer on the heat insulation ceramic layer has been found to better maintain the exhaust gas temperature in the exhaust port. The resulting maintained exhaust gas temperature can provide high efficiency in calalytic oxidation process and in turbo-charger operation.

What is claimed is:

1. An exhaust gas port comprising a port pipe of heat resistant steel, a fibrous ceramic sheet covering the radially outer surface of said port pipe, and an aluminum layer covering the radially outer surface of said fibrous ceramic sheet, said aluminum layer being thin relative to the wall thickness of said port pipe, the port pipe covered by the fibrous ceramic sheet and the thin metal layer for being cast in an engine cylinder head block made of cast aluminum to connect a combustion chamber in the engine with an exhaust system.

2. The exhaust port as set forth in claim 1, wherein the fibrous ceramic sheet is $Al_2O_3$—$SiO_2$ ceramic.

3. The exhaust port as set forth in claim 1, wherein the thin aluminum layer is aluminum foil.

4. The exhaust port as set forth in claim 2, wherein the foil is about 50 $\mu$m thick.

5. In a process for incorporating an exhaust port assembly in the cylinder block head of an internal combustion engine during the casting of the head, the exhaust port assembly of the type having a steel pipe with a fibrous ceramic liner on the radially outer surface thereof, and the head being of cast aluminum, the improvement comprising the step of lining the radially outer surface of the fibrous ceramic liner with a thin layer of aluminum prior to the step of casting the aluminum cylinder block head around the exhaust port assembly.

* * * * *